US006401285B1

(12) United States Patent
Morris

(10) Patent No.: US 6,401,285 B1
(45) Date of Patent: Jun. 11, 2002

(54) UNDULATING SUPPORT STRUCTURE BRIDGE

(75) Inventor: David C. Morris, 455 W. 23rd, #14F, New York, NY (US) 10011

(73) Assignee: David C. Morris, New York, NY (US)

( * ) Notice: Subject to any disclaimer, the term of this patent is extended or adjusted under 35 U.S.C. 154(b) by 0 days.

(21) Appl. No.: 09/305,868

(22) Filed: May 5, 1999

(51) Int. Cl.[7] ..... E01D 4/00; E01D 11/00; E01D 12/00

(52) U.S. Cl. ..... 14/19; 14/22; 14/25

(58) Field of Search ..... 14/2, 3, 4, 9, 17, 14/18, 19, 26, 13, 25, 74.5, 75, 77.1, 78

(56) References Cited

U.S. PATENT DOCUMENTS

| | | | | | |
|---|---|---|---|---|---|
| 141,310 | A | * | 7/1873 | Bender et al. | 14/18 |
| 245,412 | A | * | 8/1881 | Smith | 14/24 |
| 309,171 | A | * | 12/1884 | Strobel | 14/25 |
| 410,201 | A | | 4/1889 | Runyon | |
| 411,499 | A | | 4/1889 | Greer | |
| 414,859 | A | * | 11/1889 | Cowdon | 14/25 |
| 430,428 | A | | 1/1890 | Lindenthal | |
| 441,862 | A | * | 12/1890 | Wildin | 14/19 |
| 513,389 | A | | 1/1894 | Greer | |
| 625,902 | A | | 5/1899 | Rieppel | |
| 629,935 | A | | 8/1899 | Strugis | |
| 804,744 | A | | 11/1905 | Lindenthal | |
| 968,552 | A | | 8/1910 | Greer | |
| 1,090,081 | A | * | 3/1914 | Luten | 14/2 |
| 1,897,470 | A | | 2/1933 | Forssell | |
| 2,266,549 | A | | 12/1941 | Hamilton | |
| 2,960,704 | A | * | 11/1960 | Stoltenburg | 14/18 |
| 3,359,587 | A | * | 12/1967 | Pleasants | 14/25 |
| 3,471,881 | A | | 10/1969 | Kawada | |
| 3,561,178 | A | | 2/1971 | Finsterwalder et al. | |
| 3,654,652 | A | * | 4/1972 | Pleasants | 14/24 |
| 3,673,624 | A | | 7/1972 | Finsterwalder et al. | |
| 3,857,130 | A | | 12/1974 | Sofronie | |
| 3,864,776 | A | | 2/1975 | Hedefine et al. | |
| 4,223,495 | A | | 9/1980 | Peter | |
| 4,513,465 | A | * | 4/1985 | Schambeck | 14/17 |
| 4,589,156 | A | * | 5/1986 | Schambeck | 14/4 |
| 4,704,754 | A | * | 11/1987 | Banasso | 14/20 |
| 4,866,803 | A | | 9/1989 | Nedelcu | |
| D311,338 | S | | 10/1990 | Lindenthal | |
| 5,208,932 | A | | 5/1993 | Muller | |
| D436,606 | S | | 1/2001 | Lantz | |

OTHER PUBLICATIONS

Proposal for Eastern Span of the Bay Bridge, May 5, 1997, David C. Morris.

* cited by examiner

*Primary Examiner*—Robert E. Pezzuto
*Assistant Examiner*—Raymond W Addie
(74) *Attorney, Agent, or Firm*—Law Office of Timothy E. Siegel

(57) ABSTRACT

A bridge comprising a set of bases, a deck, an undulating support structure having above-the-deck arch sections and below-the-deck sections and being supported by the set of bases at the below the deck sections. The bridge also includes at least two arrays of load-bearing connectors extending from the above-the-deck arch sections to the deck and supporting substantially the entire weight of the deck. A preferred embodiment of the bridge comprises a deck, a wishbone arch section, including a single topmost middle portion branching transversely into two support legs on either longitudinal side of the topmost middle portion and a set of connectors extending from the wishbone arch to the deck and supporting the deck. The bridge generally includes a deck, an arch and an array of load-bearing connectors extending downwardly and longitudinally inwardly from the arch to the deck and supporting the deck in tension.

3 Claims, 6 Drawing Sheets

UNDULATING SUPPORT STRUCTURE BRIDGE

BACKGROUND OF THE INVENTION

The present invention is a design for a bridge having a suspended deck.

The problem of constructing a bridge presents a challenge on a number of intersecting intellectual planes. A bridge design should be easy-to-construct, durable, able to withstand the assaults of nature, including traumatic events such as earthquakes, and should be aesthetically pleasing. To fill these needs a number of different designs have been created. Two designs of particular interest are the double tower suspension bridge and the arch suspension bridge.

In the typical suspension bridge a pair of main cables are suspended between the tops of a pair of towers. A set of substantially vertical cables suspend the deck of the bridge from the main cables. In an arch suspension bridge, a set of vertical cables typically suspend a deck from an arch. Both of these designs represent popular favorites, as they have a minimum of support structure beneath the deck that would therefore interfere with navigation.

FIG. 1 shows a prior art bridge 10 that was invented by the inventor of the present invention. In bridge 10 a sinusoidal support structure 12 rises above and falls below a deck 14 of bridge 10, by turns forming a first arch 16 and a second arch 18. A first tower 20 and a second tower 22 support structure 12 (a further portion of structure 12, extending off of the right side of FIG. 1, is rooted into the earth). A pair of tower extensions 24 and 26 directly support deck 14. In addition, support structure 12 supports deck 14 at a set of crossing points 27 and, further, forms a loop 28 and a shelf 30 for support of deck 14. A set of cables 40, lend further support to deck 14. Unfortunately, the support of column extensions 24 and 26 and at crossing points 27 could prove to rigid and brittle during an earthquake. In the ideal, a bridge design should have built into it great flexibility, so that it can withstand earthquakes.

SUMMARY OF THE INVENTION

The present invention is a bridge, comprising a set of bases, a deck, an undulating support structure having above-the-deck arch sections and below-the-deck inverted arch sections and being supported by the set of bases at the below the deck sections. The bridge also includes at least two arrays of load-bearing connectors extending from the above-the-deck arch sections to the deck and supporting substantially the entire weight of the deck.

In a preferred separate embodiment, the present invention is a bridge comprising a deck, an arch and an array of load-bearing connectors extending downwardly and longitudinally inwardly from the arch to the deck and supporting the deck in tension.

In an alternative preferred separate embodiment, the present invention is a bridge comprising a deck, a wishbone arch section, including a single topmost middle portion branching transversely into two support legs on either longitudinal side of the topmost middle portion and a set of connectors extending from the wishbone arch to the deck and supporting the deck.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
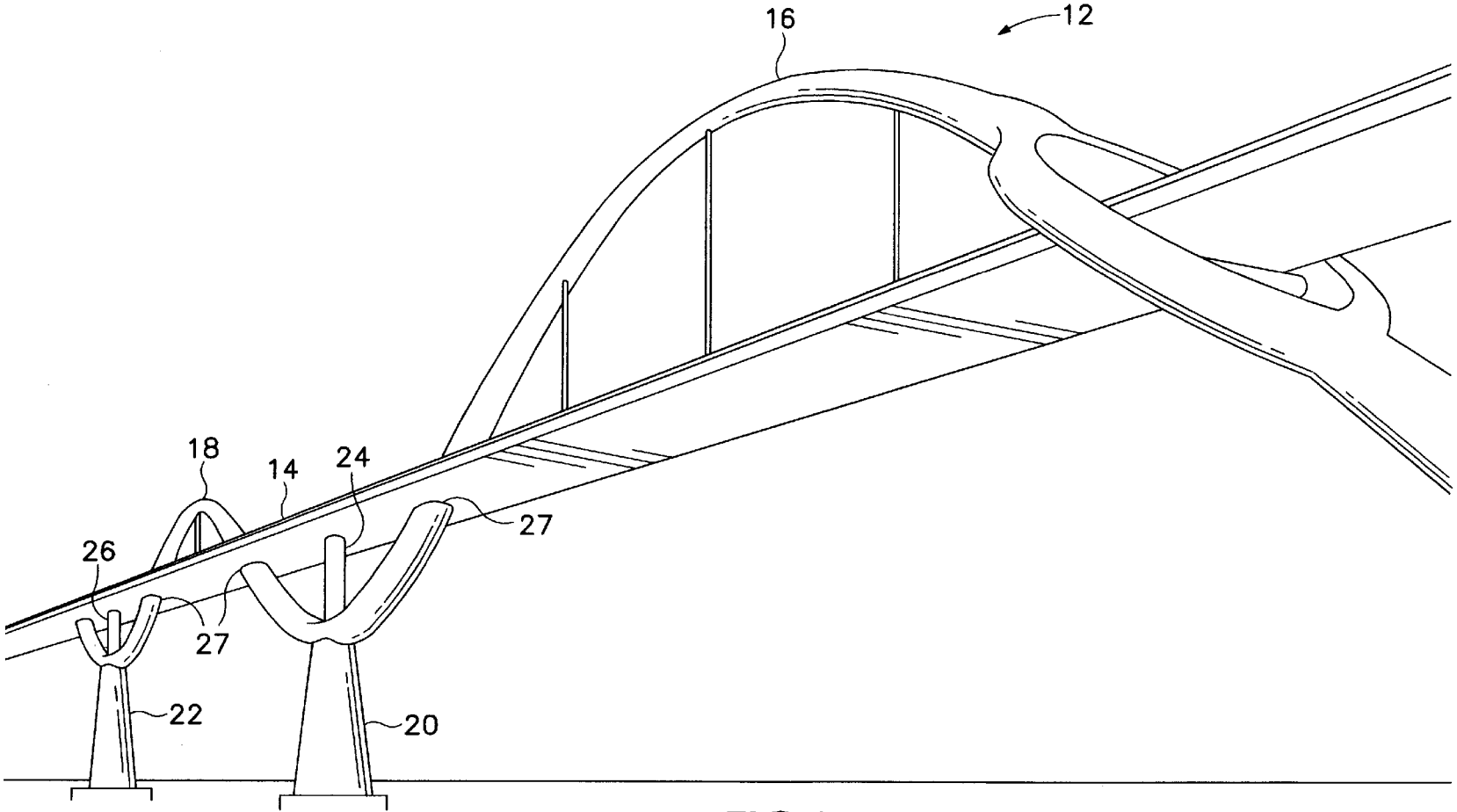
FIG.1 PRIOR ART
FIG. 1 is a perspective view of a prior art bridge design.

A bridge design 110 according to the present invention includes an undulating support structure 112 that extends above a deck 114 to form a first arch 116 and a second arch 118. Structure 112 also extends below the deck 114 in a first inverted arch 120 and a second inverted arch 122. Structure 112 is supported at the first inverted arch 120 by a first base 124, comprising a set of columns and at the second inverted arch 122 by a second base 126, comprising a set of columns. A first focused array of connectors 140 (in the form of steel cables) supports deck 114 below first arch 116 and a second focused array of connectors 142 supports deck 114 below second arch 118. Arrays 140 and 142 are focused in the sense that the lines upon which the connectors extend all cross at the same point (as illustrated by a focus point 150 for array 140).

Both first arch 116 and second arch 118 split apart into four arms, two at either longitudinal end, 116*a*, 116*b*, 116*c* and 116*d* ; and 118*a*, 118*b*, 118*c* and 118*d*, respectively, to form a wishbone structure. This design has the advantage that a single arch such as 116 or 118, has broad support from four arms. The support of deck 114 by focused arrays of cables 140 and 142 provides a balanced load which places arches 116 and 118 in compression and deck 114 in tension. Arrays 140 and 142 also are attached to and thereby support deck 114 at two transversely separated lines 160. Arches 116 and 118 are, in a sense, cable-stayed arches in that the cable arrays 140 and 142 help to hold the arches as close as possible to pure compression.

This bridge embodiment 110 bears many advantages over a conventional suspension bridge. First the undulating structure 112, which is preferably in the form of a sinusoid, is a shape that has a good capacity for absorbing the vibrations caused by earthquakes. In a conventional suspension bridge the deck is entirely "dead weight," pulling straight down on the suspension cables. However, in the bridge design 110 that conforms to the present invention, the deck 114 acts as a tension element, pulling arches 116 and 118 internally together in substantially pure compression. In addition, the weight of the deck 114 and of inverted arches 120 and 122 naturally tends to pull inverted arches 120 and 122 outwardly, but the tensioning of the deck 114 pulls inwardly on inverted arches 120 and 122 helping to support the inverted arches 120 and 122. This pulling is performed by way of a set of direct connections between the inverted arches 120 and 122 and the deck 114 (not shown, but preferably of a sort that would allow a maximum amount of movement between the structure 112 and the deck 114, while still supporting the deck) or in a separate preferred embodiment in which deck 114 receives no direct support from structure 112 by the outward pulling action of the focused arrays of cables 140 and 142.

The deck 114 may be composed primarily of concrete and/or steel.

Figure 5:
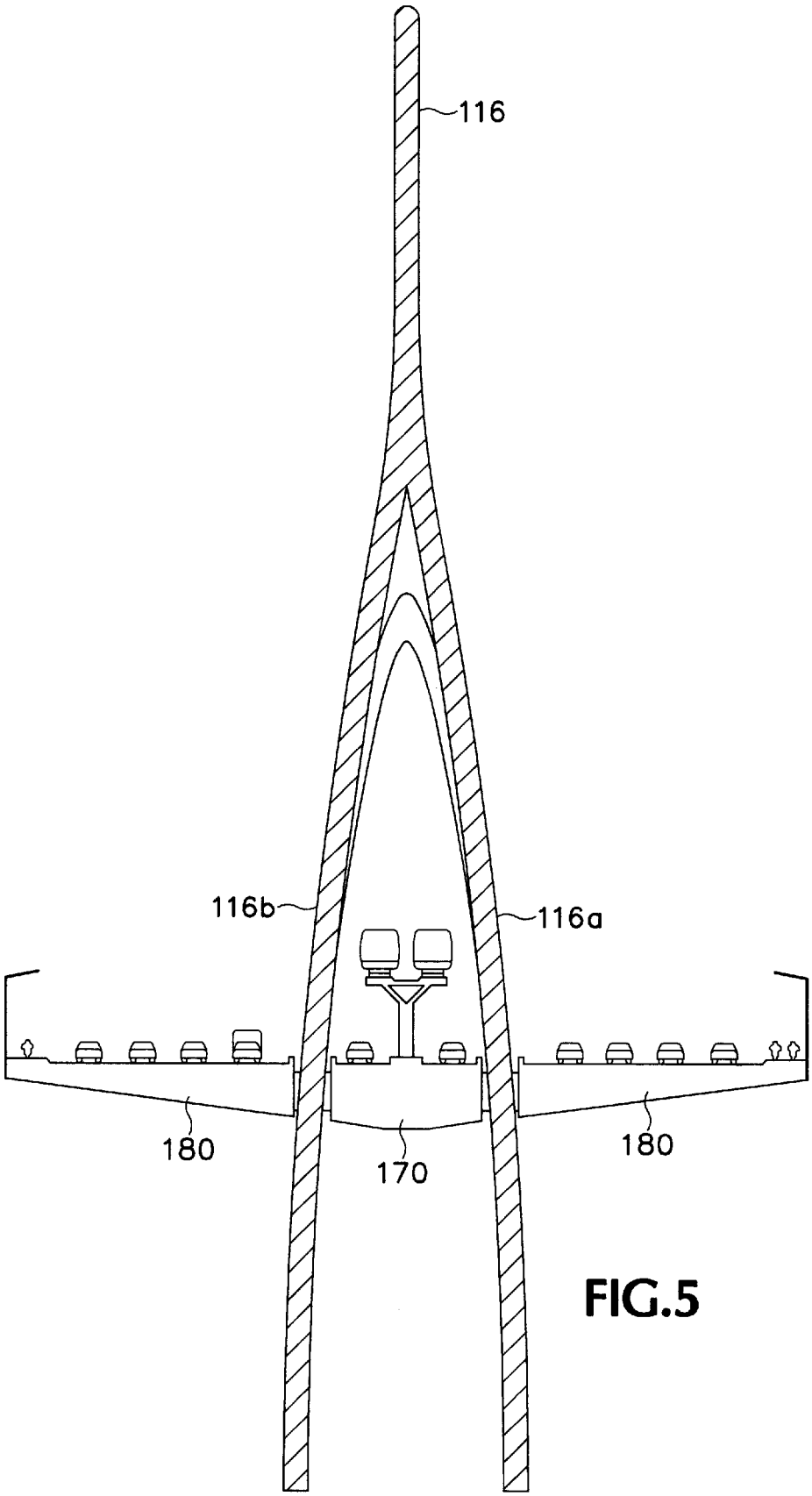
FIG. 5 is a cross-sectional view of the bridge of FIG. 2 taken along line 5—5 of FIG. 2.
Figure 6:
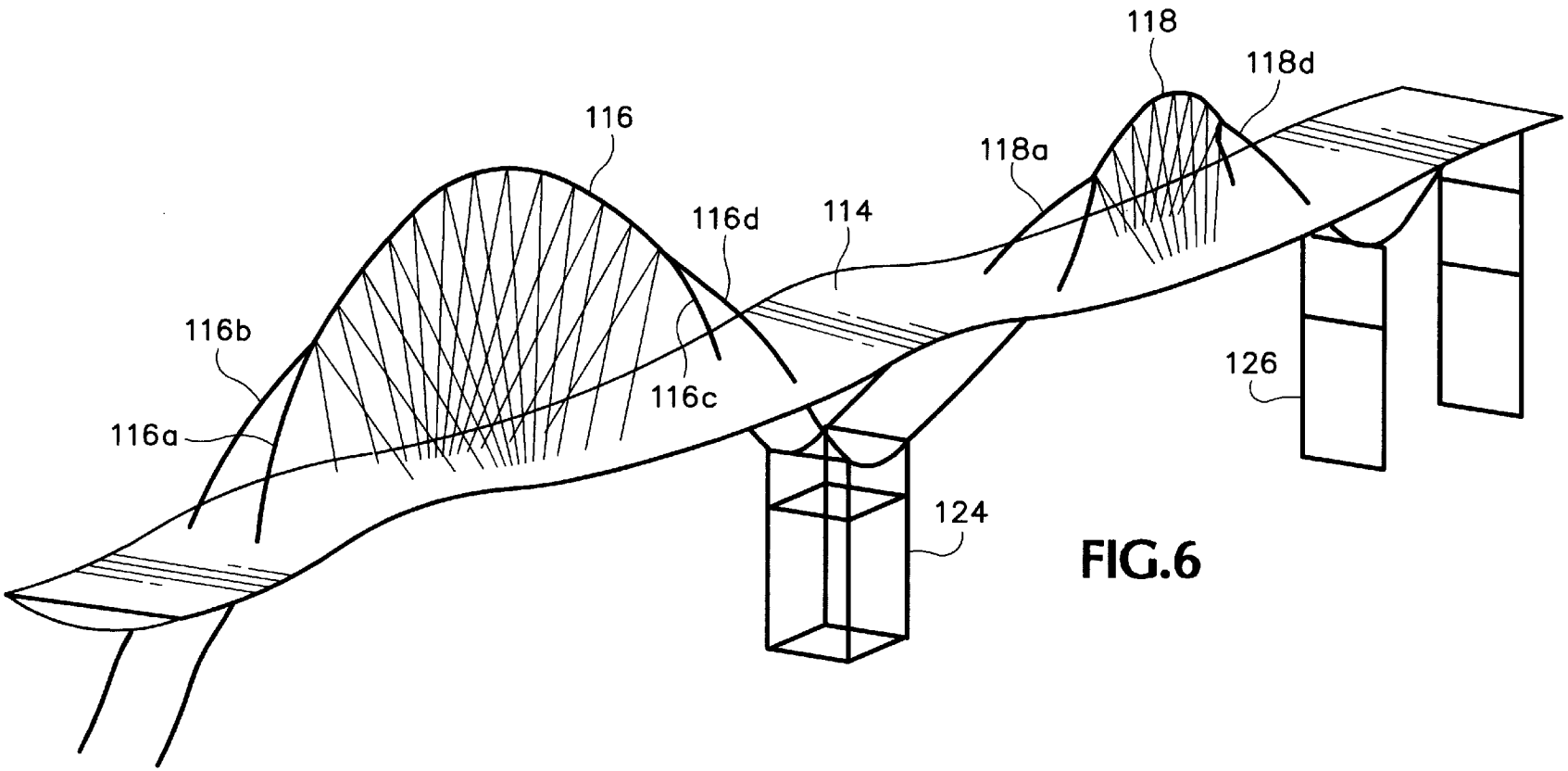
FIG. 6 is an abstracted structural diagram of the bridge of FIG. 2.

Referring to FIG. 5, deck portions 180 are cantilevered outward from deck portion 170, which sustains the tensile forces induced by arrays 140 and 142.

The support structure is preferably produced in segments. Each segment is preferably made as a polygonal structural tube-in-tube concrete filled construction. The outer polygonal tubular steel form is clad with a thin veneer of stainless steel thereby producing a reflective, very low maintenance exterior. Basic units of this type could be shop-welded to form segments having accoutrements to accept fasteners. The segments are fastened together at the job site, by way of the accoutrements, thereby facilitating construction.

The deck is preferably formed of structural steel, preferably in the form of a grid, as is typical in bridge design.

Figure 2:
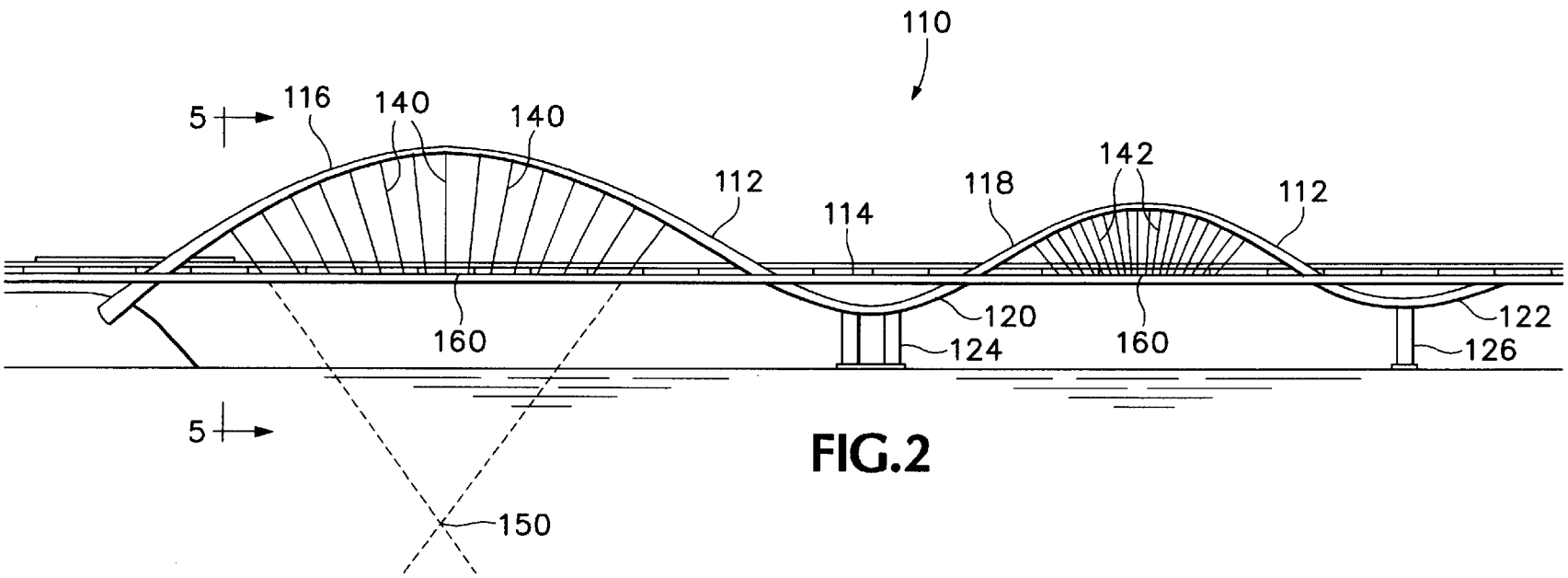
FIG. 2 is a side view of a bridge according to the present invention.
Figure 3:
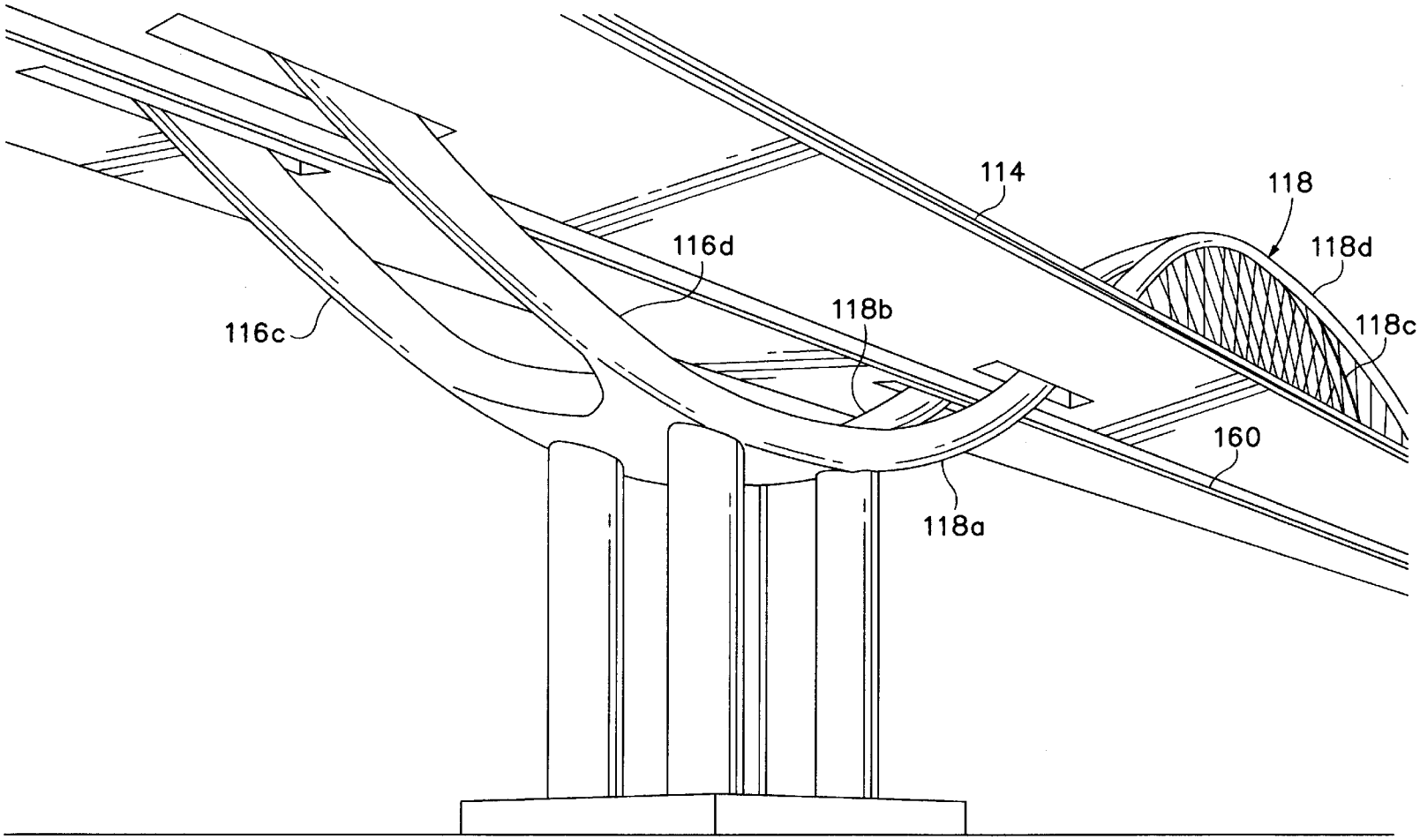
FIG. 3 is an upward-looking perspective view of a portion of the bridge of FIG. 2.
Figure 4:
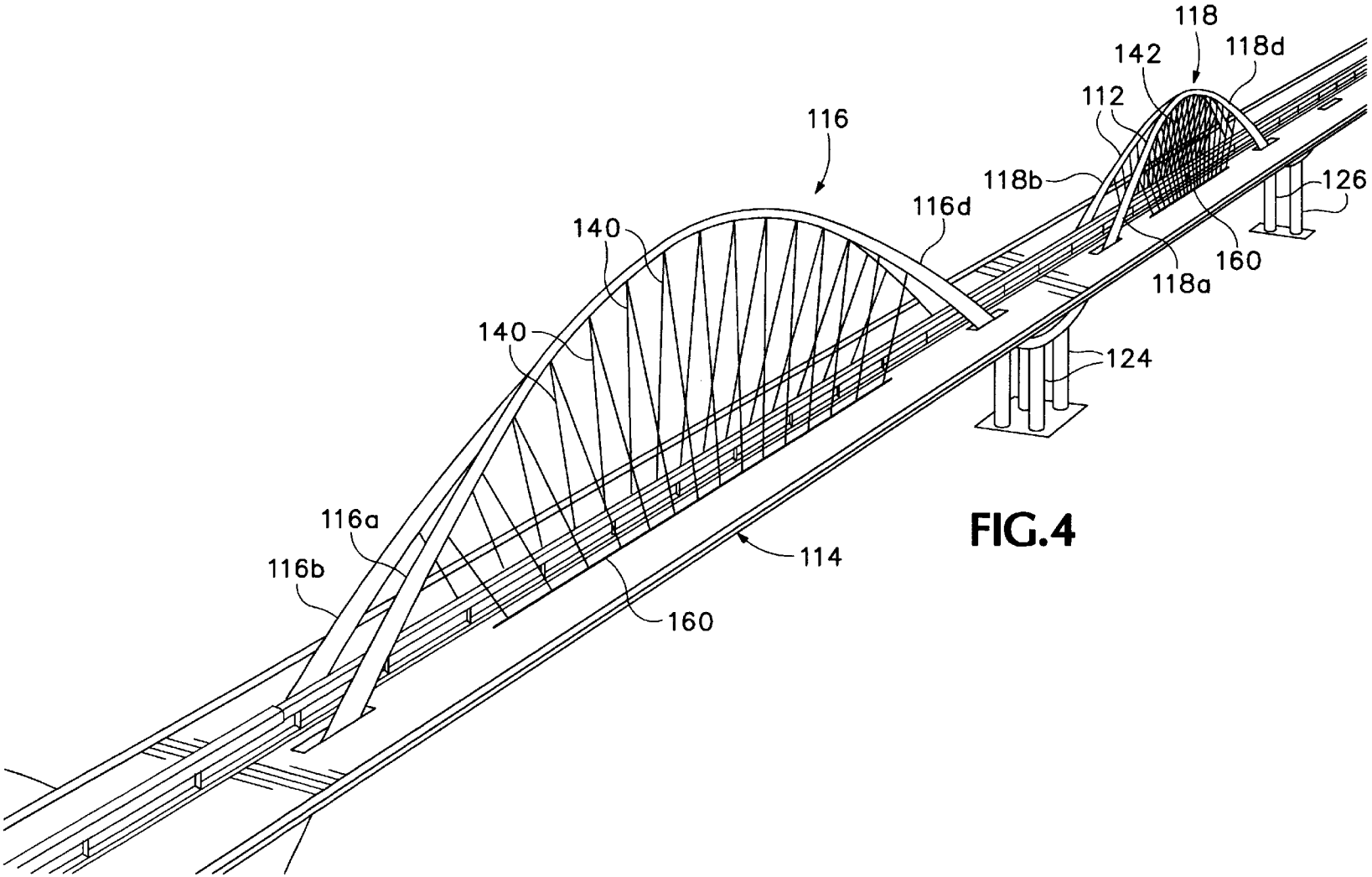
FIG. 4 is a downward-looking perspective view of a portion of the bridge of FIG. 2.

The wishbone construction described earlier results in the partial isolation, by the intersection of the arch arms 116*a*, 116*b*, 116*c*, 116*d*, 118*a*, 118*b*, 118*c* and 118*d* with the deck 114, of center lanes 170, which are inside the arch arms 116*a*–118*d* and the outer lanes 180 which are outside of the arch arms 116*a*–118*d*. This partial separation can be used positively by assigning the center lanes to mass transit, as shown in FIGS. 2, 4 and 5, or car pools and the outer lanes to general traffic.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A bridge, comprising (a) a set of bases;

(b) a deck;

(c) an undulating support structure having at least two above-the-deck arch sections arches and a below-the-deck inverted arch and being supported by at least one of said set of bases at said below the deck inverted arch, said support structure having no discontinuities in its curvature; and (d) a multi-cable array of load-bearing connectors extending from each said above-the-deck arch to said deck and supporting said deck, said deck and said undulating support structure not being rigidly connected together at any place.

2. The bridge of claim 1 wherein said arrays of load-bearing connectors extend radially inwardly from said arch to said deck, supporting said deck in tension.

3. The bridge of claim 2 wherein each said array of load-bearing connectors is focused to a point beneath said deck.

* * * * *

UNITED STATES PATENT AND TRADEMARK OFFICE

CERTIFICATE OF CORRECTION

PATENT NO. : 6,401,285 B1
DATED : June 11, 2002
INVENTOR(S) : David C. Morris

It is certified that error appears in the above-identified patent and that said Letters Patent is hereby corrected as shown below:

Title page,
Item [57], ABSTRACT,
Line 4, change "below the deck" to -- below-the-deck --.

Column 1,
Line 37, change "to" to -- too --.
Line 45, change "below the deck" to -- below-the-deck --.

Column 4,
Line 13, change "arch sections arches" to -- arches --.
Line 15, change "below the deck" to -- below-the-deck --.

Signed and Sealed this

Seventeenth Day of September, 2002

*Attest:*

*Attesting Officer*

JAMES E. ROGAN
*Director of the United States Patent and Trademark Office*